US008505133B1

(12) United States Patent
Pollard, Sr.

(10) Patent No.: US 8,505,133 B1
(45) Date of Patent: Aug. 13, 2013

(54) FURNITURE COMBINATION OF BED AND DESK

(71) Applicant: Albert C. Pollard, Sr., Irvington, VA (US)

(72) Inventor: Albert C. Pollard, Sr., Irvington, VA (US)

( * ) Notice: Subject to any disclaimer, the term of this patent is extended or adjusted under 35 U.S.C. 154(b) by 0 days.

(21) Appl. No.: 13/791,852

(22) Filed: Mar. 8, 2013

(51) Int. Cl.
*A47C 19/22* (2006.01)

(52) U.S. Cl.
USPC ..... 5/2.1; 5/507.1; 5/308

(58) Field of Classification Search
USPC ..... 5/2.1, 3, 9.1, 53.1, 414, 507.1; 108/49, 108/50.11, 50.14, 92, FOR. 100
See application file for complete search history.

(56) References Cited

U.S. PATENT DOCUMENTS 1,347,271 A * 7/1920 Hartman ..... 5/507.1
3,950,796 A * 4/1976 Hollingsworth ..... 5/2.1
3,952,342 A * 4/1976 Hart ..... 5/2.1
4,017,920 A * 4/1977 Sieg ..... 5/507.1
4,253,204 A * 3/1981 Tasaka ..... 5/2.1
4,312,086 A * 1/1982 Bianco ..... 5/2.1
4,589,612 A * 5/1986 Halim ..... 244/118.6
5,540,491 A * 7/1996 Wu ..... 312/237
6,167,579 B1 * 1/2001 Kopish ..... 5/2.1
6,568,001 B2 * 5/2003 Walsh ..... 5/2.1
7,036,160 B1 * 5/2006 Pecoraro ..... 5/2.1
7,832,031 B1 * 11/2010 Lupo ..... 5/9.1

OTHER PUBLICATIONS

More Cube Living: MihaDesign's NR1977 apartment, Core 77 Design Magazine & Resource, Apr. 1, 2011, 4 pages, available at http://www.core77.com/blog/object_culture/more_cube_living_mihadesigns_nr1977_apartment_19017.asp.

* cited by examiner

*Primary Examiner* — Michael Trettel
(74) *Attorney, Agent, or Firm* — Brian J. Teague

(57) ABSTRACT

A bed/desk combination wherein the desk is disposed above the bed and unneeded space above the foot of the bed is used for the sitting portion of the desk and unneeded space below the desk surface as well as further space unneeded by the desk function is used for the space above the head of the bed.

15 Claims, 11 Drawing Sheets

FURNITURE COMBINATION OF BED AND DESK

FIELD OF THE INVENTION

This invention relates to a bed and desk combination where the desk is above the bed.

BACKGROUND

Very small homes and apartments have recently become very popular. When space is limited, furniture is often used that combines several functions in one piece of furniture. Combining a bed and desk into a single peace has become a popular idea. It is well known to provide desk/bed combinations in which the bed is positioned over the desk. This combination put the bed at a height that put the user at great risk if the user fell from bed. Young children are a greater risk than adults of falling out of bed. Furthermore, parents like to tuck their children in bed which is difficult to do when the bed is elevated above a desk.

The most likely reason the bed has been put above the desk in the aforementioned prior desk/bed combinations is that in all of the identified prior arrangements, the separation between the bed and the desk has been a horizontal plane. If a horizontal plane separates the desk and bed, then space constraints would make it impractical to put the desk above the bed. If the desk were put above the bed, then the vertical space required for a person in bed would cause the desk to be impractically high off of the floor.

BRIEF SUMMARY

In one embodiment of the invention, a piece of furniture comprises a bed and a desk. The bed has a bed head end and a bed foot end, wherein, when a person lies in said bed, said person's head is at said head end and said person's feet are at said foot end and when a person sits up in said bed said person sits at said head end of said bed. The desk has a seat for a person to sit, a foot platform for said person's feet when said person is sitting in said seat, and a desk surface for supporting material while said person is sitting in said seat and performing work normally performed at a conventional desk. A center of said piece of furniture is at half the distance from said head end to said foot end. A central portion of said piece of furniture is a center one third of the piece of furniture between said head end and said foot end. Said desk is disposed above said bed with at least a portion of said foot platform above at least a portion of said bed foot end. Said foot platform extends from said foot end to less than said center. Said seat is higher than said foot platform and at least a portion of said seat is above said at least a portion of bed foot end. Said desk surface is disposed higher than said seat and at least a portion of said desk surface is above said central portion of said bed, such that an unobstructed vertical space above said bed head end is greater than an unobstructed vertical space above said bed foot end.

In an alternative embodiment of the invention, a piece of furniture comprises a bed, a right structural member, and a left structural member. The bed has a right head post and a left head post at a head of said bed and a right foot post and a left foot post at a foot of said bed. Said right structural member is connected to said to said right head post at a right head post connection point and connected to said right foot post at a right foot post connection point. Said left structural member is connected to said to said left head post at a left head post connection point and connected to said left foot post at a left foot post connection point. Said right structural member and said left structural member are configured to support a desk. Said right head post connection point and said left head post connection are each higher than each said right foot post connection point and said left foot post connection point.

In an alternative embodiment of the invention, a piece of furniture comprises a vertical head end support, a vertical foot end support, a bed platform, a first desk platform, a second desk platform, and a platform support. Said bed platform has a head end and a foot end, the head end being affixed to the vertical head end support and the foot end being affixed to the vertical foot end. Said first desk platform is affixed to the vertical head end support above the bed platform and projecting toward the vertical foot end support. Said second desk platform is affixed to the vertical foot end support above the bed platform and projecting toward the vertical head end support. Said platform support is affixed to and spanning between the first and second desk platforms. A height of the first desk platform above the bed platform is greater than a height of the second desk platform above the bed platform.

In an alternative embodiment of the invention, a piece of furniture comprises a desk for mounting on top of a bed. The bed comprises a vertical head end bed support, a vertical foot end bed support, and a bed platform having a head end and a foot end, the head end being affixed to the vertical head end bed support and the foot end being affixed to the vertical foot end bed support. The desk comprises a vertical head end desk support, a vertical foot end desk support, a first desk platform, a second desk platform, and a platform support. Said vertical head end desk support is configured for mounting on top of the vertical head end bed support. Said vertical foot end desk support is configured for mounting on top of the vertical foot end bed support. Said first desk platform is affixed to the vertical head end desk support and projecting toward the vertical foot end desk support. Said second desk platform is affixed to the vertical foot end desk support and projecting toward the vertical head end desk support. Said platform support is affixed to and spanning between the first and second desk platforms. When the desk is mounted on top of the bed, a height of the first desk platform above the bed platform is greater than a height of the second desk platform above the bed platform.

In addition to the piece of furniture, as described above, other embodiments of the invention are directed to corresponding methods of mounting a desk above a bed.

BRIEF DESCRIPTION OF THE SEVERAL VIEWS OF THE DRAWING(S)

Reference is made herein to the accompanying drawings, which are not necessarily drawn to scale, and wherein:

FIG. 1 illustrates one embodiment of a bed/desk combination, in accordance with embodiments of the invention.

FIG. 2*a* illustrates a knock-down embodiment of the bed/desk in its assembled position, in accordance with alternative embodiments of the invention.

FIG. 2*b* illustrates the knock-down embodiment of the bed desk of FIG. 2*a*, partially disassembled.

FIG. 2*c* illustrates the knock-down bed desk of FIG. 2*a*, fully knocked down.

FIGS. 3*a*-3*e* illustrate simplified side views of various bed/desk combinations, in accordance with alternative embodiments of the invention.

DETAILED DESCRIPTION

Embodiments of the invention disclosed herein provide a unitary furniture item comprising a combination of a bed and a desk in which the desk is positioned above the bed. Advantageously, different portions of the desk are spaced different amounts from the bed to provide more space above the head of the bed, thereby enabling a user to sit up in the bed while providing a space-efficient solution that is not unnecessarily tall.

Figure 1:
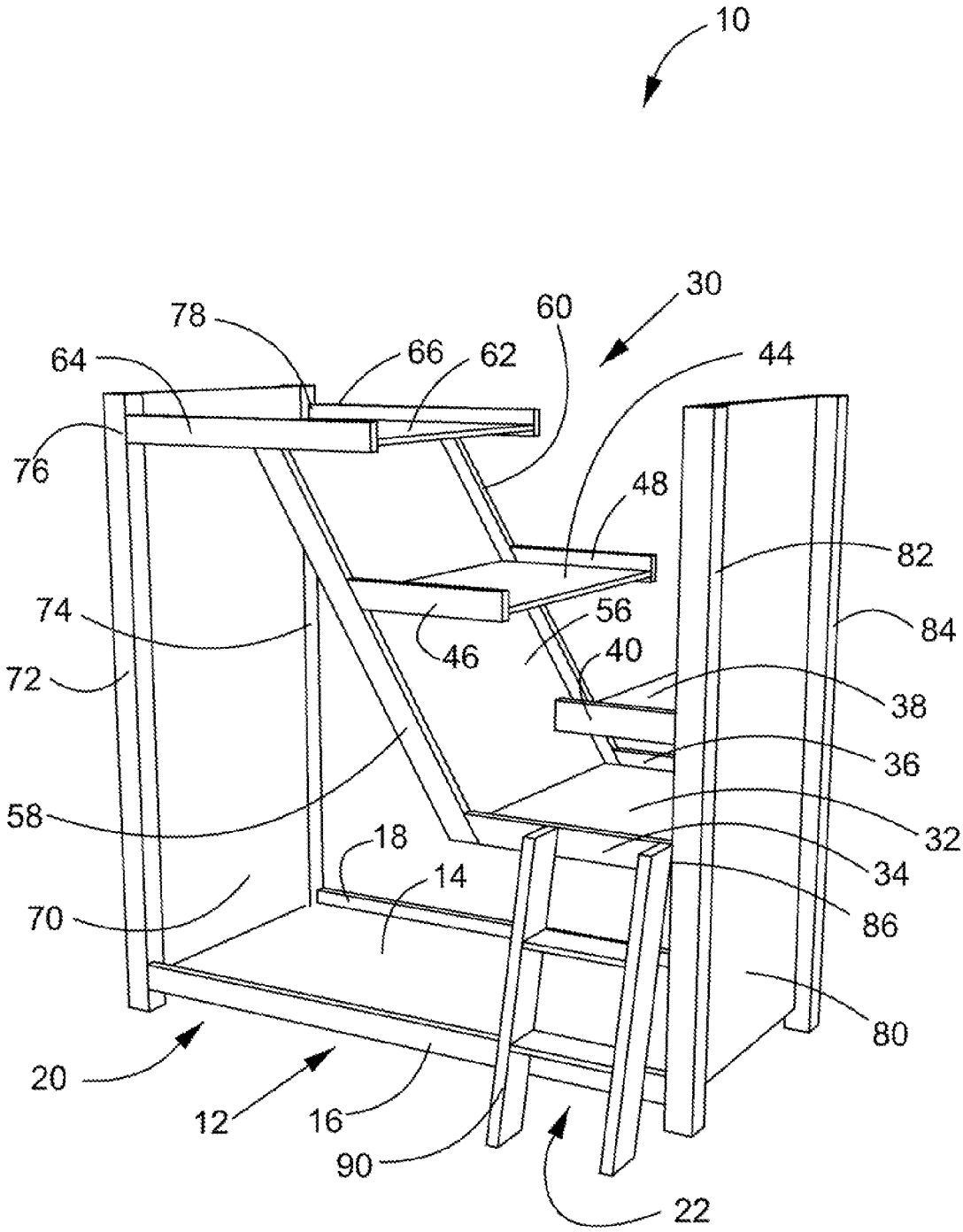

Referring now to the figures, wherein like numerals indicate like elements throughout, there are illustrated bed/desk combinations in accordance with embodiments of the present invention. FIG. 1 illustrates a bed/desk combination 10 in accordance with one embodiment of the current invention. The bed/desk combination 10 comprises a bed portion 12 with a desk portion 30 disposed above the bed portion 12. The bed portion 12 comprises a bed platform 14 that supports a mattress upon which a user may sit or lie down. The bed platform is in turn supported by a right bed rail 16 and a left bed rail 18. The bed platform 14 may comprise a single, planar board, as illustrated, or may comprise a plurality of separate mattress support rails aligned perpendicular to and supported by the right and left bed rails. The bed portion 12 has a bed head end 20 and a bed foot end 22. The bed head end 20 is supported by a vertical head end support, and the bed foot end 22 is supported by a vertical foot end support, such that the bed platform is supported by the vertical head and foot end supports. The vertical head end support comprises a planar head board 70 spanning a right head post 72 and a left head post 74. In alternative embodiments of the invention, the planar head board 70 may be omitted and the vertical head end support may comprise only a right head post 72 and a left head post 74. In another alternative embodiment, the right and left head posts may be omitted and the vertical head end may comprise only a planar head board (which would likely need to be more structurally strong that is otherwise needed if the head posts are present).

The vertical foot end support comprises a planar foot board 80 spanning a right foot post 82 and a left foot post 84. In alternative embodiments of the invention, the planar foot board 80 may be omitted and the vertical foot end support may comprise only a right foot post 82 and a left foot post 84. In another alternative embodiment, the right and left foot posts may be omitted and the vertical foot end may comprise only a planar foot board (which would likely need to be more structurally strong that is otherwise needed if the foot posts are present).

Desk portion 30 is supported by the vertical head end support and the vertical foot end support in a position above the bed portion 12. Advantageously, there is more vertical space between the head end 20 of the bed and the desk portion 30 than between the foot end 22 of the bed and the desk portion 30. This enables a user to sit up in the bed while providing a space-efficient solution that is not unnecessarily tall. The desk portion 30 is comprised of a top platform, a foot platform, an angled or vertical support assembly spanning the top and foot platforms, a seat, and a desk surface. The top platform projects from the vertical head end support. In the illustrated embodiment, the top platform projects substantially horizontally from the vertical head end support. However, the top platform may project at some other angle, For example, the top platform may project downward (at any desired angle) from the vertical head end support. The top platform comprises a planar board 62 supported by a right support arm 64 and a left support arm 66. The right support arm 64 is affixed to the right head post 72 at a right head post connection point 76. The left support arm 66 is affixed to the left head post 74 at a left head post connection point 78. In addition to supporting the angled or vertical support assembly and the foot platform, the top platform may function as a shelf for holding books, office supplies, etc. In an alternative embodiment, the right and left support arms 64, 66 may be omitted and the top platform may comprise only a planar board (which would likely need to be more structurally strong that is otherwise needed if the support arms are present). In alternative embodiments further described below, a separate desk surface may be omitted and the top platform may function as a desk surface (such an alternative embodiment would typically require that the angled or vertical support assembly be shorter than in the embodiment of FIG. 1).

The foot platform projects from the vertical foot end support. In the illustrated embodiment, the foot platform projects substantially horizontally from the vertical foot end support. However, the foot platform may project at some other angle, For example, the foot platform may project downward (at any desired angle) from the vertical foot end support. The foot platform comprises a planar board 32 supported by a right support arm 34 and a left support arm 36. The right support arm 34 is affixed to the right foot post 82 at a right foot post connection point 86. The left support arm 36 is affixed to the left foot post 84 at a left foot post connection point (not illustrated). The foot platform supports a user's feet as the user sits in the built-in seat (illustrated in FIG. 1 and described below). In an alternative embodiment, the right and left support arms 34, 36 may be omitted and the foot platform may comprise only a planar board (which would likely need to be more structurally strong that is otherwise needed if the support arms are present). In an alternative embodiment of the invention in which the built-in seat is omitted, a standard, free-standing chair may be placed on the foot platform.

The seat projects from the vertical foot end support. In the illustrated embodiment, the seat projects substantially horizontally from the vertical foot end support. However, the seat may project at some other angle, For example, the seat may project downward (at any desired angle) from the vertical foot end support. The seat comprises a planar or contoured board 38 supported by a right support arm 40 and a left support arm (not illustrated). The right support arm 40 is affixed to the right foot post and the left support arm is affixed to the left foot post, such that the seat is a wide as the foot board 80. Alternatively, the right and left support arms of the seat may be affixed to the planar foot board 80 (i.e., in between the right and left foot posts), thereby enabling the seat to be narrower than the foot board 80. In an alternative embodiment, the right and left support arms may be omitted and the seat may comprise only a planar board (which would likely need to be more structurally strong that is otherwise needed if the support arms are present). The cantilevered connection between the seat and the vertical foot end support may limit the weight capacity of the seat. One or more seat supports (not illustrated) may be placed between the underside of the seat and the foot platform to provide additional strength to the seat, thereby enabling the seat to support more weight without substantially increasing the strength of the connection between the seat and the vertical foot end support.

The angled support assembly (which alternatively may be a vertical support assembly, as described below) spans the top platform and the foot platform. The angled support assembly comprises a planar board 56 supported by a right support arm 58 and a left support arm 60. A top end of the angled support assembly is affixed to the top platform and a bottom end of the angled support assembly is affixed to the foot platform. Rigid and sturdy affixation of the top platform, the angled support assembly, and the foot platform enable the desk portion 30 to span from the vertical head end support to the vertical foot end support without any intermediate supports, thereby providing an unobstructed space between the bed portion and the desk portion. The angled support assembly further functions to partition the desk portion to help prevent items on the desk surface from falling off the desk surface and onto the bed. An opening (not illustrated) may be defined in the planar board 56 adjacent the foot platform to enable a user to extend his/her legs (by placing his/her feet through the opening) to vary his/her sitting position. In an alternative embodiment, the right and left support arms 58, 60 may be omitted and the foot platform may comprise only a planar board (which would likely need to be more structurally strong that is otherwise needed if the support arms are present).

The desk surface projects from the angled support assembly, about midway between the top platform and the foot platform. In the illustrated embodiment, the desk surface projects substantially horizontally from the angled support assembly. However, the desk surface may project at some other angle, For example, the desk surface may project downward (at any desired angle) from the angled support assembly. The desk surface comprises a planar board 44 supported by a right support arm 46 and a left support arm 48. In an alternative embodiment, the right and left support arms 46, 48 may be omitted and the desk surface may comprise only a planar board (which would likely need to be more structurally strong that is otherwise needed if the support arms are present).

Ladder 90 facilitates user access to the desk portion 30, enabling a user to climb up to the elevated foot platform.

Some or all of the components described above as being affixed to each other may be removably affixed to each other, such that the bed/desk combination 10 may be disassembled for ease of transport, storage, etc.

Note that the bed head end 20 or head of the bed has enough vertical space so one could sit up in bed and read. On the other hand, the bed foot end 22 or foot of the bed has plenty of room for ones feet but has much less vertical space the bead head end 20. On the other hand the desk portion 30 requires more vertical space where one sits on the seat and requires much less space above the desk surface. The current invention takes advantage of these different space requirements by dividing the space between the bed and desk so as to provide the space to the bed or desk where it is needed most In the embodiment of FIG. 1, the right and left support arms (64, 58, 34 and 66, 60, 36) provide, through affixation to the vertical head and foot end supports, the support for the desk portion. The right support arms (64, 58, 34) are rigidly affixed to each other, and the left support arms (66, 60, 36) are rigidly affixed to each other, as illustrated, to function as structural members (although they may be removably affixed, as mentioned above). However, in alternative embodiments of the invention, illustrated in FIGS. 2*a*-2*c*, these support arms may be removably fastened or may be hinged to one another to facilitate folding of the desk portion for transporting and/or storing the bed/desk.

Figure 2A:
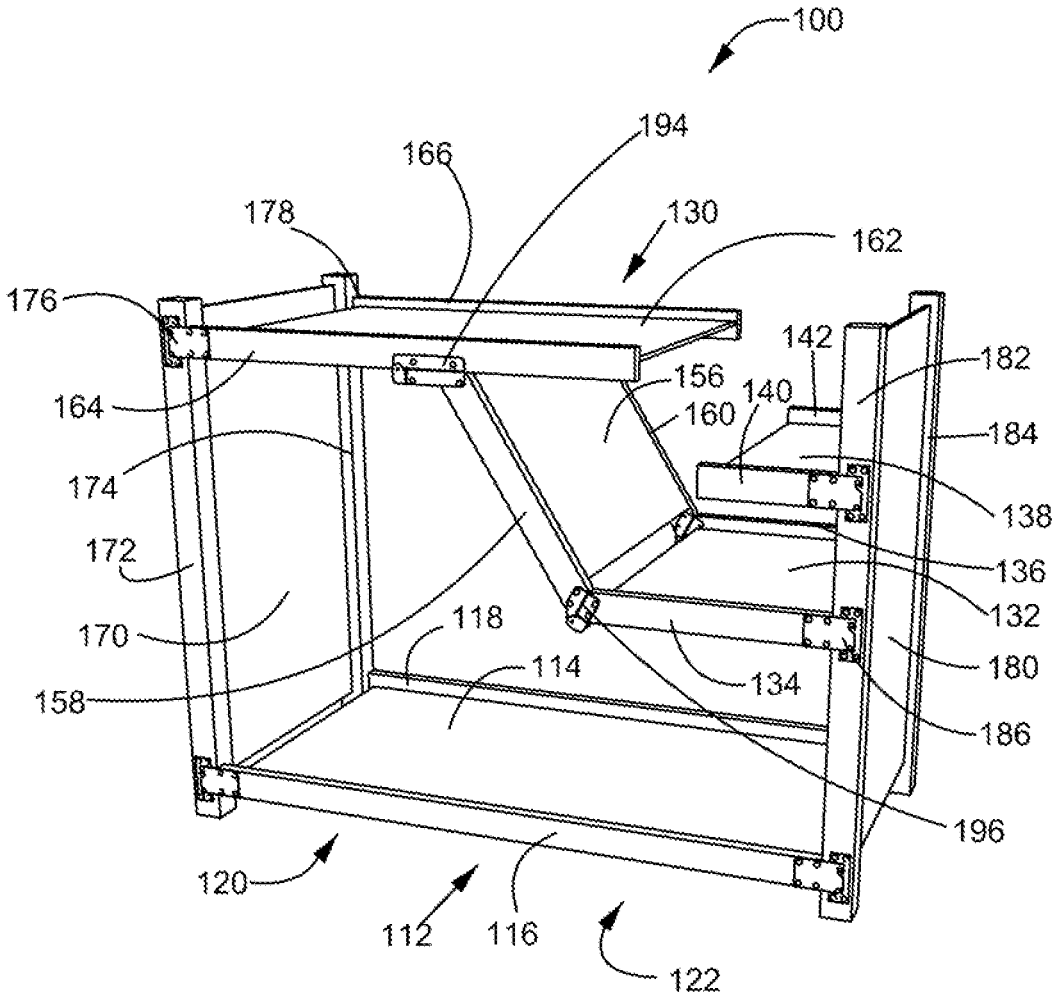
Figure 2B:
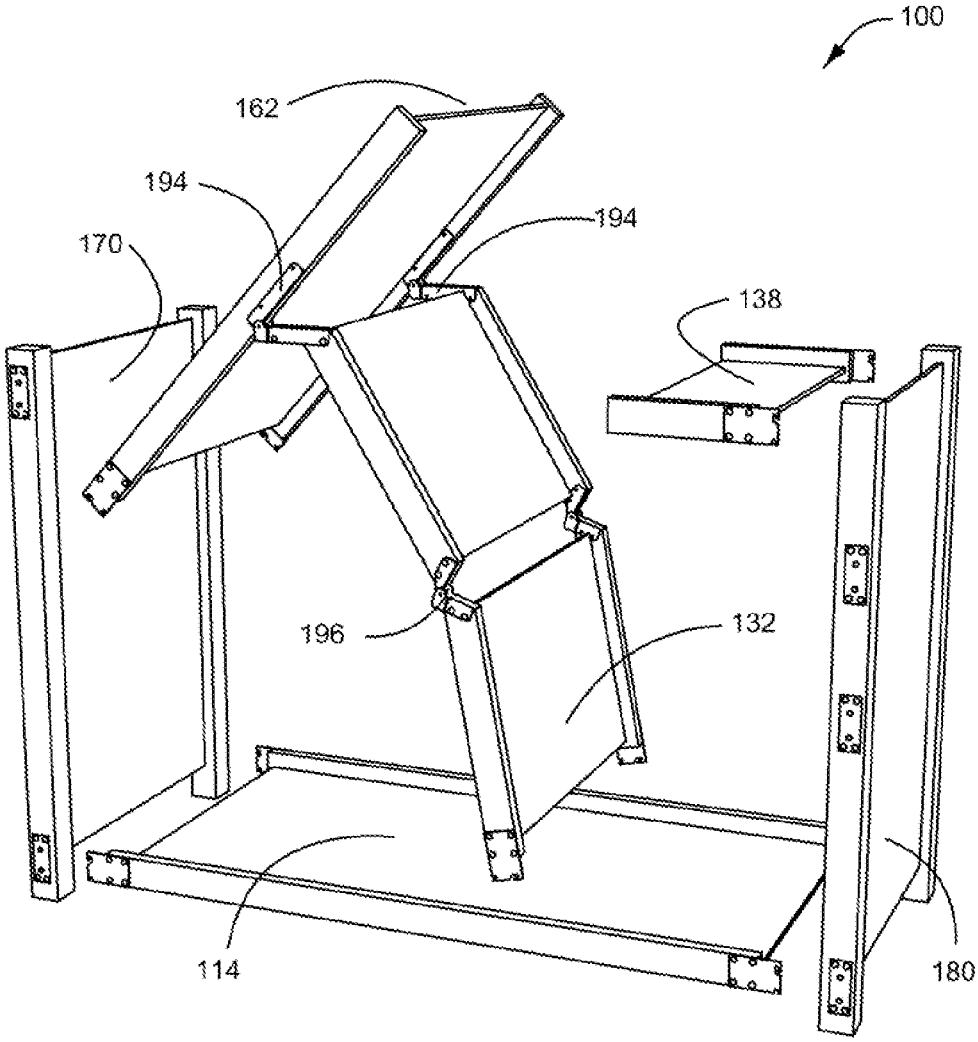
Figure 2C:
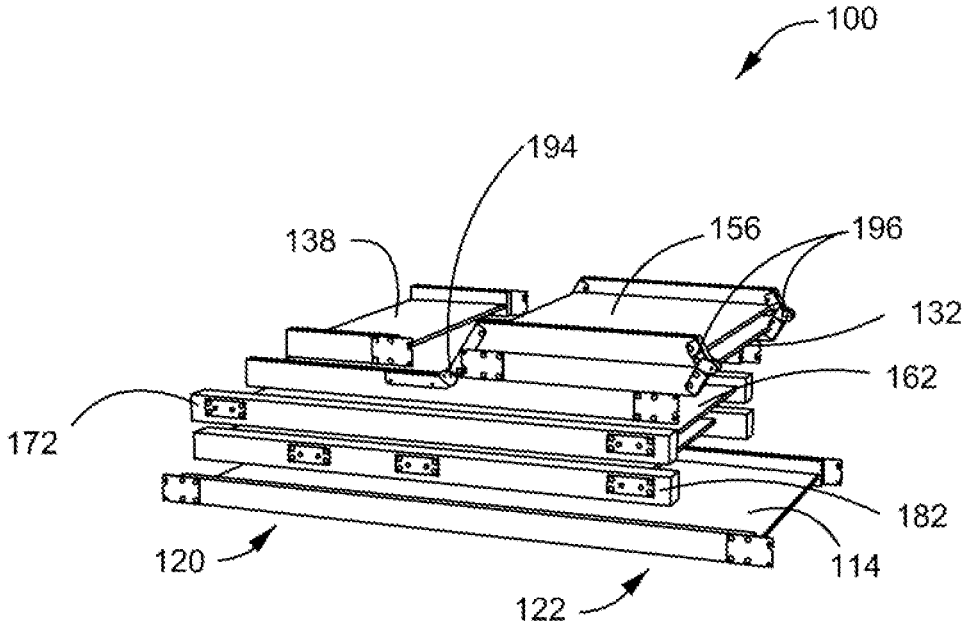

FIGS. 2*a*-2*c* illustrate a knock-down embodiment of the bed-desk. The bed/desk combination 100 of FIGS. 2*a*-2*c* comprises a bed portion 112 with a desk portion 130 disposed above the bed portion 112. The bed portion 112 comprises a bed platform 114 that supports a mattress upon which a user may sit or lie down. The bed platform is in turn supported by a right bed rail 116 and a left bed rail 118. The bed platform 114 may comprise a single, planar board, as illustrated, or may comprise a plurality of separate mattress support rails aligned perpendicular to and supported by the right and left bed rails. The bed portion 112 has a bed head end 120 and a bed foot end 122. The bed head end 120 is supported by a vertical head end support, and the bed foot end 122 is supported by a vertical foot end support, such that the bed platform is supported by the vertical head and foot end supports. The vertical head end support comprises a planar head board 170 spanning a right head post 172 and a left head post 174. In alternative embodiments of the invention, the planar head board 170 may be omitted and the vertical head end support may comprise only a right head post 172 and a left head post 174. In another alternative embodiment, the right and left head posts may be omitted and the vertical head end may comprise only a planar head board (which would likely need to be more structurally strong that is otherwise needed if the head posts are present).

The vertical foot end support comprises a planar foot board 180 spanning a right foot post 182 and a left foot post 184. In alternative embodiments of the invention, the planar foot board 180 may be omitted and the vertical foot end support may comprise only a right foot post 182 and a left foot post 184. In another alternative embodiment, the right and left foot posts may be omitted and the vertical foot end may comprise only a planar foot board (which would likely need to be more structurally strong that is otherwise needed if the foot posts are present).

Desk portion 130 is supported by the vertical head end support and the vertical foot end support in a position above the bed portion 112. As in the embodiment of FIG. 1, there is more vertical space between the head end 120 of the bed and the desk portion 130 than between the foot end 122 of the bed and the desk portion 130. The desk portion 130 is comprised of a top platform, a foot platform, an angled or vertical support assembly spanning the top and foot platforms, and a seat. (Unlike the embodiment of FIG. 1, the bed/desk 100 of FIGS. 2*a*-2*c* does not include a separate desk surface. Rather, the top platform extends further toward the vertical foot end support to function as a desk surface.) The top platform projects from the vertical head end support (as above, the top platform may project substantially horizontally or at some other angle). The top platform comprises a planar board 162 supported by a right support arm 164 and a left support arm 166. The right support arm 164 is removably affixed to the right head post 172 at a right head post connection point 176. The left support arm 166 is removably affixed to the left head post 174 at a left head post connection point 178. In an alternative embodiment, the right and left support arms 164, 166 may be omitted and the top platform may comprise only a planar board (which would likely need to be more structurally strong that is otherwise needed if the support arms are present).

The foot platform projects from the vertical foot end support (as above, the foot platform may project substantially horizontally or at some other angle). The foot platform comprises a planar board 132 supported by a right support arm 134 and a left support arm 136. The right support arm 134 is removably affixed to the right foot post 182 at a right foot post connection point 186. The left support arm 136 is removably affixed to the left foot post 184 at a left foot post connection point (not illustrated). The foot platform supports a user's feet as the user sits in the built-in seat. In an alternative embodiment, the right and left support arms 134, 136 may be omitted and the foot platform may comprise only a planar board (which would likely need to be more structurally strong that is otherwise needed if the support arms are present). In an alternative embodiment of the invention in which the built-in seat is omitted, a standard, free-standing chair may be placed on the foot platform.

The seat projects from the vertical foot end support (as above, the seat may project substantially horizontally or at some other angle). The seat comprises a planar or contoured board 138 supported by a right support arm 140 and a left support arm 142. The right support arm 140 is removably affixed to the right foot post 182 and the left support arm 142 is removably affixed to the left foot post 184, such that the seat is a wide as the foot board 180. Alternatively, the right and left support arms of the seat may be affixed to the planar foot board 180 (i.e., in between the right and left foot posts), thereby enabling the seat to be narrower than the foot board 180. In an alternative embodiment, the right and left support arms 140, 142 may be omitted and the seat may comprise only a planar or contoured board (which would likely need to be more structurally strong that is otherwise needed if the support arms are present). The cantilevered connection between the seat and the vertical foot end support may limit the weight capacity of the seat. One or more seat supports (not illustrated) may be placed between the underside of the seat and the foot platform to provide additional strength to the seat, thereby enabling the seat to support more weight without substantially increasing the strength of the connection between the seat and the vertical foot end support.

Attachments of the horizontal members of the bed and the desk to the vertical posts may be by means a hardware principle well known in the furniture industry. This hardware may use members with slots on the horizontal members to fit over pins on the vertical members.

The angled support assembly (which alternatively may be a vertical support assembly, as described below) spans the top platform and the foot platform. The angled support assembly comprises a planar board 156 supported by a right support arm 158 and a left support arm 160. The top end of the angled support assembly is hingedly affixed to the top platform using top hinge 194 (only one is illustrated, but there is one on each side of the angled support assembly). The bottom end of the angled support assembly is hingedly affixed to the foot platform using bottom hinge 196 (only one is labeled, but there is one on each side of the angled support assembly). The upper hinge 194 and lower hinge 196 allow for folding the desk portion 130. The hinges are disposed on the tension side or underside of the structural members. Because the hinges are on the tension side of the structural members, this results in a rigid structure when the bed/desk is full assembled.

The angled support assembly further functions to partition the desk portion to help prevent items on the desk surface from falling off the desk surface and onto the bed. An opening (not illustrated) may be defined in the planar board 56 adjacent the foot platform to enable a user to extend his/her legs (by placing his/her feet through the opening) to vary his/her sitting position. In an alternative embodiment, the right and left support arms 58, 60 may be omitted and the foot platform may comprise only a planar board (which would likely need to be more structurally strong that is otherwise needed if the support arms are present).

FIG. 2*b* illustrates the desk/bed 100 of FIG. 2*a* partially disassembled. Note how the upper hinge 194 and the lower hinge 196 now allow for the folding of the desk portion 120 whereas when full assembled these hinges held the structural members rigid.

FIG. 2*c* shows the bed/desk 100 of FIG. 2*a* fully folded and stacked as it may be prepared for shipping or storage.

Figure 3A:
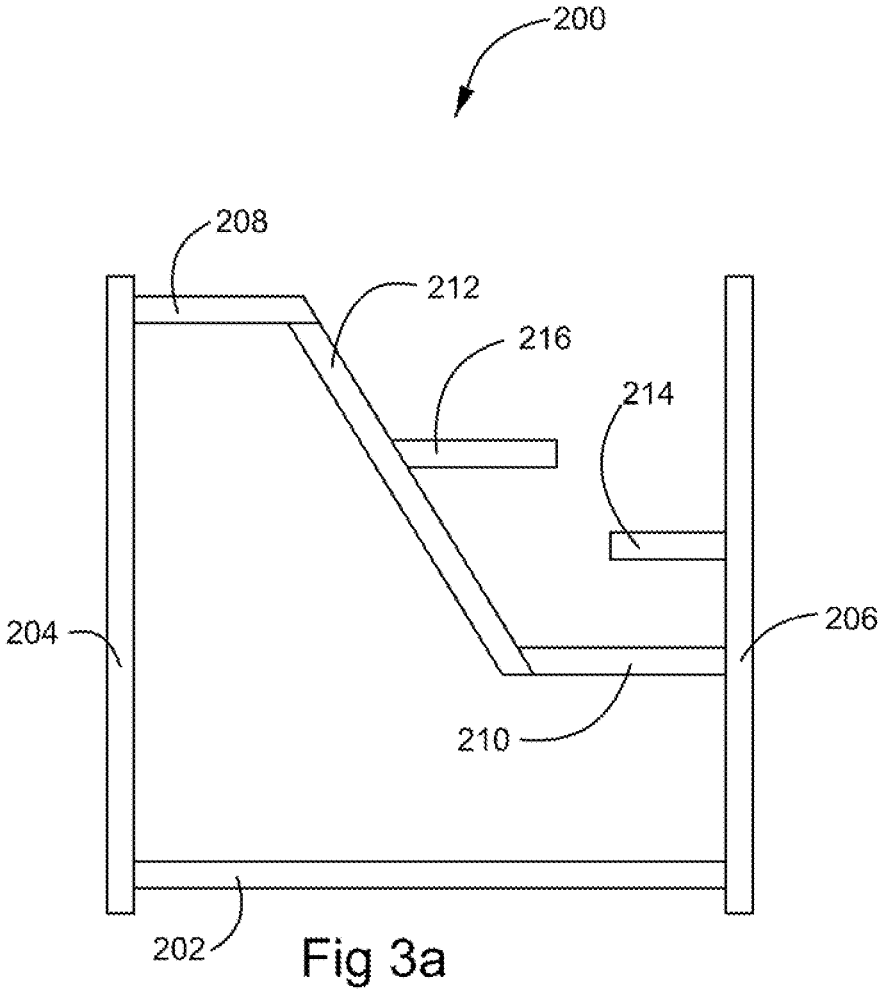

FIGS. 3*a*-3*e* illustrate simplified side views of alternative embodiments of the invention. FIG. 3*a* illustrates a bed/desk combination 200 comprising a bed platform 202, a vertical head end support 204, a vertical foot end support 206, a top platform 208 affixed to the vertical head end support 204, a foot platform 210 affixed to the vertical foot end support 206, an angled support 212 spanning between the top platform 208 and the foot platform 210, a seat 214 affixed to the vertical foot end support 206, and a desk surface 216 affixed to the angled support 212. Bed/desk combination 200 of FIG. 3*a* differs from the bed/desk combination of FIG. 1 in that the top end of the angled support 212 of bed/desk combination 200 is affixed to the distal end of the top platform 208, such that the top platform 208 does not project beyond the angled support.

Figure 3B:
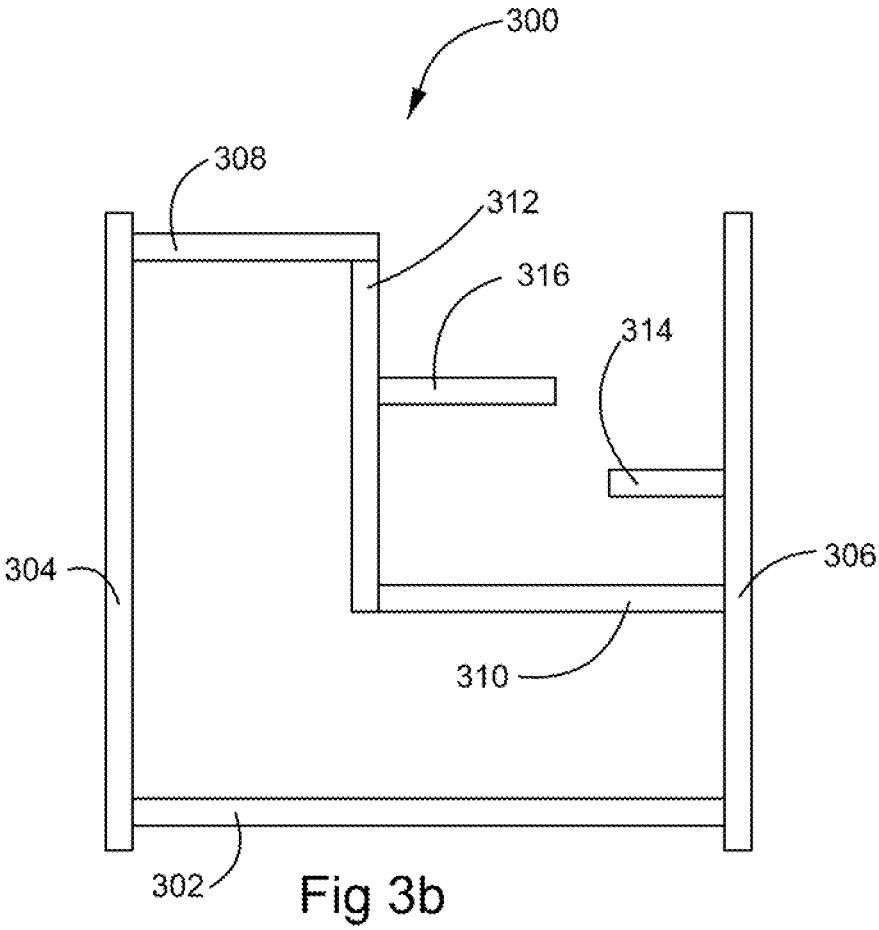

FIG. 3*b* illustrates a bed/desk combination 300 comprising a bed platform 302, a vertical head end support 304, a vertical foot end support 306, a top platform 308 affixed to the vertical head end support 304, a foot platform 310 affixed to the vertical foot end support 306, a vertical support 312 spanning between the top platform 308 and the foot platform 310, a seat 314 affixed to the vertical foot end support 306, and a desk surface 316 affixed to the vertical support 312. Bed/desk combination 300 of FIG. 3*b* differs from the bed/desk combination of FIG. 1 in that (a) bed/desk combination 200 has a vertical support between the top platform and the foot platform, rather than an angled support, and (b) the top end of the vertical support 312 of bed/desk combination 300 is affixed to the distal end of the top platform 308, such that the top platform 308 does not project beyond the vertical support.

Figure 3C:
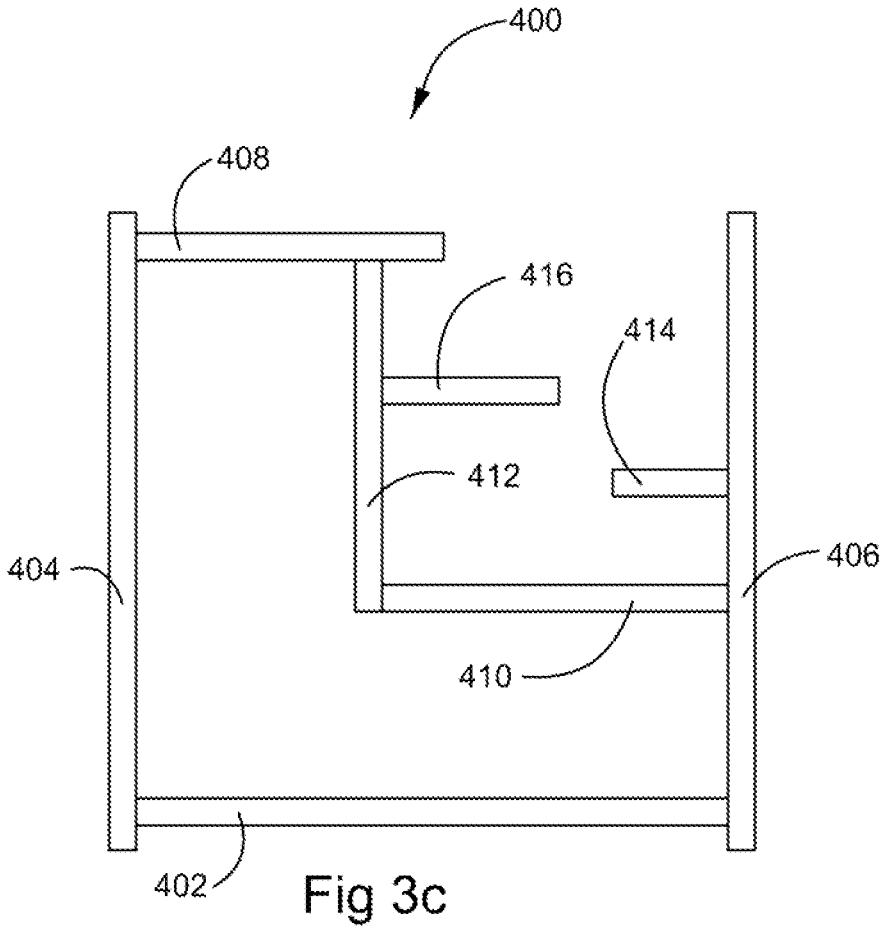

FIG. 3*c* illustrates a bed/desk combination 400 comprising a bed platform 402, a vertical head end support 404, a vertical foot end support 406, a top platform 408 affixed to the vertical head end support 404, a foot platform 410 affixed to the vertical foot end support 304, a vertical support 412 spanning between the top platform 408 and the foot platform 410, a seat 414 affixed to the vertical foot end support 406, and a desk surface 416 affixed to the vertical support 412. Bed/desk combination 400 of FIG. 3*c* differs from the bed/desk combination of FIG. 1 in that bed/desk combination 400 has a vertical support between the top platform and the foot platform, rather than an angled support. Bed/desk combination 400 of FIG. 3*c* is similar to the bed/desk combination of FIG. 1 in that the top end of the vertical support 412 of bed/desk combination 400 is affixed to the top platform 408 such that the top platform 408 projects beyond the vertical support.

Figure 3D:
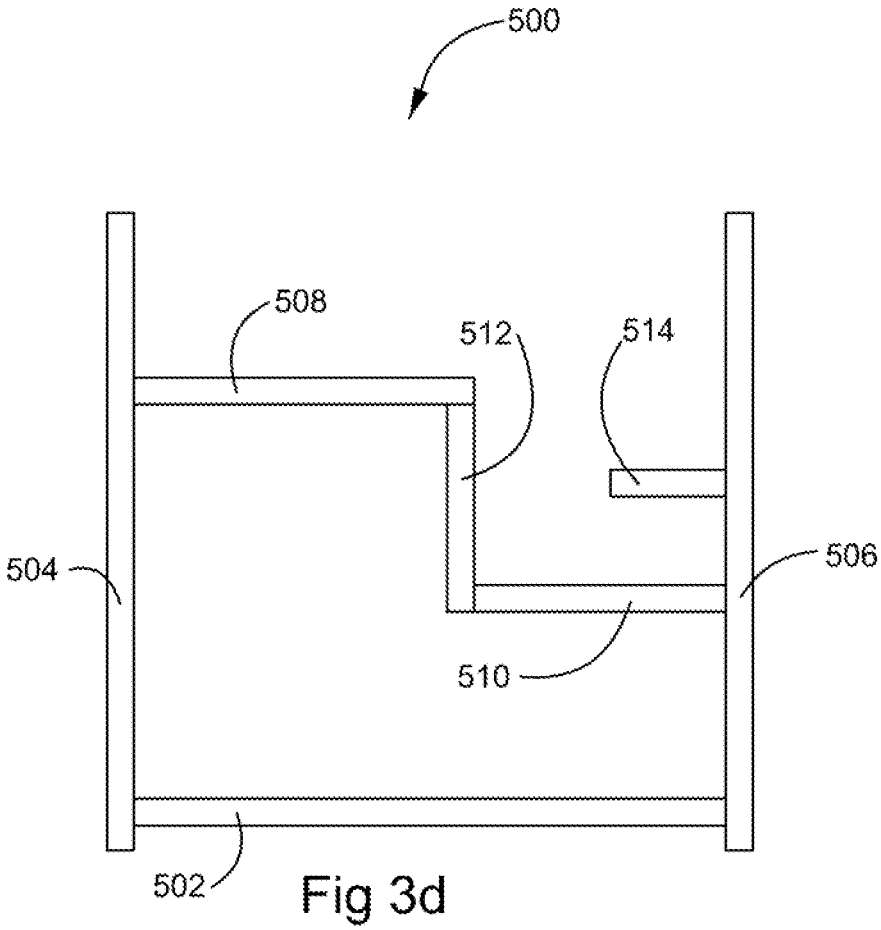

FIG. 3*d* illustrates a bed/desk combination 500 comprising a bed platform 502, a vertical head end support 504, a vertical foot end support 506, a top platform 508 affixed to the vertical head end support 504, a foot platform 510 affixed to the vertical foot end support 506, a vertical support 512 spanning between the top platform 508 and the foot platform 510, and a seat 514 affixed to the vertical foot end support 506. Bed/desk combination 500 of FIG. 3*d* differs from the bed/desk combination of FIG. 1 in that (a) bed/desk combination 500 has a vertical support between the top platform and the foot platform, rather than an angled support, (b) the top end of the vertical support 512 of bed/desk combination 500 is affixed to the distal end of the top platform 508, such that the top platform 508 does not project beyond the vertical support, and (c) bed/desk combination 500 does not include a separate desk surface, but rather the top platform 508 functions as a desk surface.

Figure 3E:
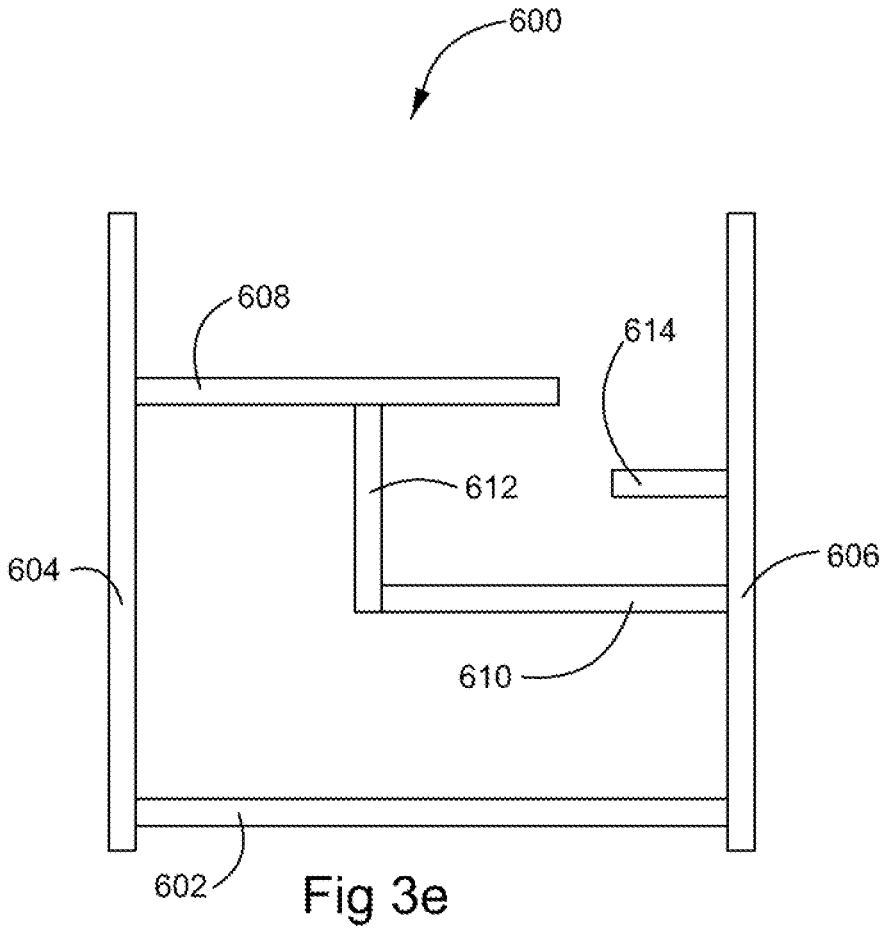

FIG. 3*e* illustrates a bed/desk combination 600 comprising a bed platform 602, a vertical head end support 604, a vertical foot end support 606, a top platform 608 affixed to the vertical head end support 604, a foot platform 610 affixed to the vertical foot end support 604, a vertical support 612 spanning between the top platform 608 and the foot platform 610, and a seat 614 affixed to the vertical foot end support 606. Bed/ desk combination 600 of FIG. 3*e* differs from the bed/desk combination of FIG. 1 in that (a) bed/desk combination 600 has a vertical support between the top platform and the foot platform, rather than an angled support, and (b) bed/desk combination 600 does not include a separate desk surface, but rather the top platform 608 functions as a desk surface. Bed/desk combination 600 of FIG. 3*e* is similar to the bed/desk combination of FIG. 1 in that the top end of the vertical support 612 of bed/desk combination 600 is affixed to the top platform 608 such that the top platform 608 projects beyond the vertical support.

FIGS. 3*a*-3*e* all illustrate bed/desk combinations with substantially horizontal top platforms, foot platforms, and desk surfaces. As described above, these components may project substantially horizontally, as illustrated, or any other desired angle.

Figure 4:
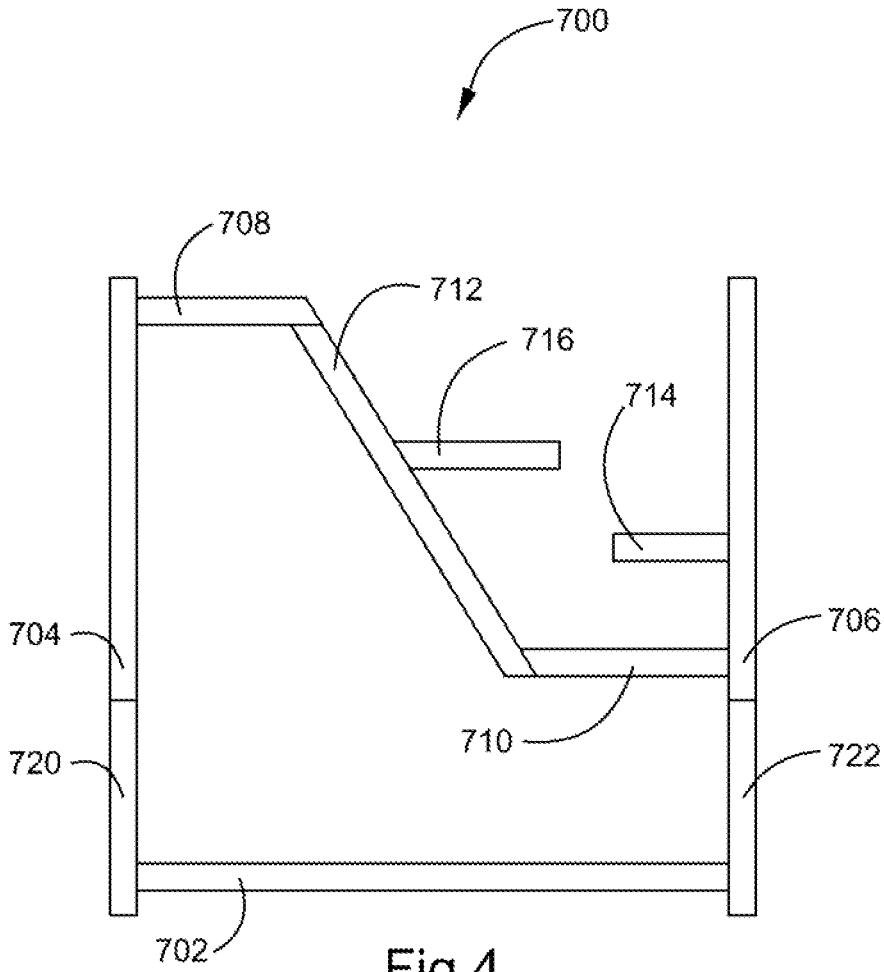
FIG. 4 illustrates a simplified side view of a desk mounted on a bed, in accordance with alternative embodiments of the invention.

FIG. 4 illustrates a simplified side view of an alternative embodiment of the invention. FIG. 4 illustrates bed/desk combination 700 which comprises a desk that is mountable on top of a bed similar to a top bunk bed mounting on top of a bottom bunk bed. The bed may be a standard bottom bunk bed having a bed platform 702, a head board 720, and a foot board 722. The head and foot boards are typically of equal heights. The desk comprises a vertical head end support 704, a vertical foot end support 706, a top platform 708 affixed to the vertical head end support 704, a foot platform 710 affixed to the vertical foot end support 706, an angled support 712 spanning between the top platform 708 and the foot platform 710, a seat 714 affixed to the vertical foot end support 706, and a desk surface 716 affixed to the angled support 712. While the desk of bed/desk combination 700 is similar to that of FIG. 2*a*, any suitable configuration of desk may be used (e.g., any of the desks illustrated in FIG. 1, 2 or 3*a*-3*e*). The head and foot boards of the bed are configured to accept and securely support the desk. Features that enable the head and foot boards of the bed to accept and securely support the desk may include, but are not limited to, (a) the equal heights of the head and foot boards, (b) relatively thick head and footboards to provide a wide, stable base for the desk, and (c) corresponding holes defined the tops of the head and foot boards and the bottoms of the vertical head and foot end supports that accept dowels or other types of pins to prevent horizontal movement of the desk relative to the bed.

Figure 5:
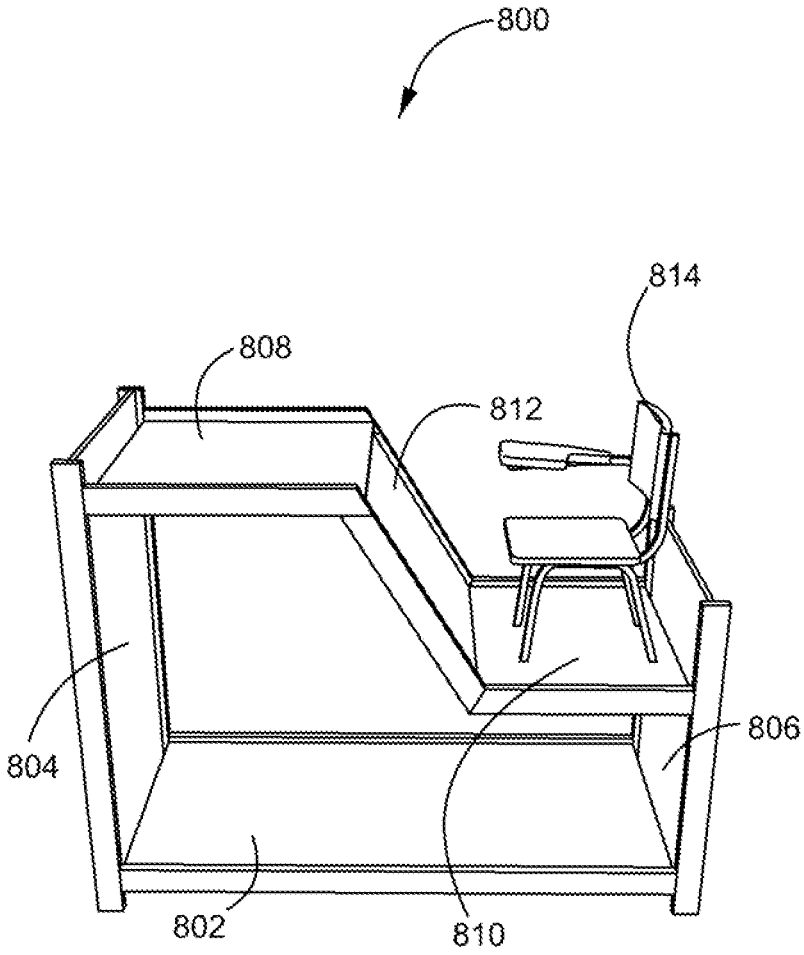
FIG. 5 illustrates a bed with a desk-supporting platform, in accordance with alternative embodiments of the invention.

FIG. 5 illustrates a bed with a desk-supporting platform, in accordance with alternative embodiments of the invention. Similar to the above-described embodiments, the furniture piece 800 of FIG. 5 comprises a bed platform 802, a vertical head end support 804, a vertical foot end support 806, a top platform 808 affixed to the vertical head end support 804, a foot platform 810 affixed to the vertical foot end support 806, and an angled support 812 spanning between the top platform 808 and the foot platform 810. Unlike the above embodiments, the furniture piece 800 of FIG. 5 does not include an integral seat or desk surface. Rather, a standard tablet arm desk 814 may be placed on top of the foot platform for a user to sit upon and work.

Conclusion, ramifications and scope.

As the reader can see, embodiments of the current invention provide a bed/desk combination wherein the space requirements of the bed and desk have been balanced to maximize the utility of each. Heretofore the space between the bed and desk has been separated by a horizontal plane, however in this novel invention the division of space between the bed and the desk has been accomplished by dividing the spaces according to the need of the bed and the desk. Accordingly, the scope of this invention should not be determined by the embodiments illustrated herein by the appended claims and their legal equivalents.

Certain terminology is used in the following description for convenience only and is not limiting. The words "lower," "bottom," "upper," and "top" designate directions in the drawings to which reference is made. The words "left," "right," "up," "upward," "down," and "downward" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A piece of furniture comprising:

a bed having a bed head end and a bed foot end, wherein, when a person lies in said bed, said person's head is at said head end and said person's feet are at said foot end and when a person sits up in said bed said person sits at said head end of said bed;

a desk having a seat for a person to sit, a foot platform for said person's feet when said person is sitting in said seat, and a desk surface for supporting material while said person is sitting in said seat and performing work normally performed at a conventional desk;

wherein a center of said piece of furniture is at half the distance from said head end to said foot end;

wherein a central portion of said piece of furniture is a center one third of the piece of furniture between said head end and said foot end;

wherein said desk is disposed above said bed with at least a portion of said foot platform above at least a portion of said bed foot end;

wherein said foot platform extends from said foot end to less than said center;

wherein said seat is higher than said foot platform and at least a portion of said seat is above said at least a portion of bed foot end; and wherein said desk surface is disposed higher than said seat and at least a portion of said desk surface is above said central portion of said bed, such that an unobstructed vertical space above said bed head end is greater than an unobstructed vertical space above said bed foot end.

2. A piece of furniture comprising:

a bed having a right head post and a left head post at a head of said bed and a right foot post and a left foot post at a foot of said bed;

a right structural member connected to said to said right head post at a right head post connection point and connected to said right foot post at a right foot post connection point;

a left structural member connected to said to said left head post at a left head post connection point and connected to said left foot post at a left foot post connection point;

wherein said right structural member and said left structural member are configured to support a desk; wherein said right head post connection point and said left head post connection are each higher than each said right foot post connection point and said left foot post connection point; wherein said right structural member is removably connected to said right head post at said right head post connection point and removably connected to said right foot post at said right foot post connection point; wherein said left structural member is removably connected to said left head post at said left head post connection point and removably connected to said left foot post at said left foot post connection point; and wherein said right structural member and said left structural member have one or more hinges disposed on a respective tension side of each thereby facilitating folding.

3. A piece of furniture comprising:

a vertical head end support;

a vertical foot end support;

a bed platform having a head end and a foot end, the head end being affixed to the vertical head end support and the foot end being affixed to the vertical foot end;

a first desk platform affixed to the vertical head end support above the bed platform and projecting toward the vertical foot end support;

a second desk platform affixed to the vertical foot end support above the bed platform and projecting toward the vertical head end support; and a platform support affixed to and spanning between the first and second desk platforms;

wherein a height of the first desk platform above the bed platform is greater than a height of the second desk platform above the bed platform.

4. The piece of furniture of claim 3, wherein the platform support is affixed either to (i) a distal end of the first desk platform opposite the vertical head end support or (ii) a portion of the first desk platform between the distal end and the vertical head end support.

5. The piece of furniture of claim 3, wherein the platform support is affixed either to (i) a distal end of the second desk platform opposite the vertical foot end support or (ii) a portion of the second desk platform between the distal end and the vertical foot end support.

6. The piece of furniture of claim 3, further comprising:

a work platform affixed to the platform support lower than the first desk platform and higher than the second desk platform and projecting toward the vertical foot end support.

7. The piece of furniture of claim 3, further comprising:

a seat affixed to the vertical foot end support above the second desk platform and projecting toward the vertical head end support.

8. A desk for mounting on top of a bed, the bed comprising a vertical head end bed support, a vertical foot end bed support, and a bed platform having a head end and a foot end, the head end being affixed to the vertical head end bed support and the foot end being affixed to the vertical foot end bed support, the desk comprising:

a vertical head end desk support configured for mounting on top of the vertical head end bed support;

a vertical foot end desk support configured for mounting on top of the vertical foot end bed support;

a first desk platform affixed to the vertical head end desk support and projecting toward the vertical foot end desk support;

a second desk platform affixed to the vertical foot end desk support and projecting toward the vertical head end desk support; and a platform support affixed to and spanning between the first and second desk platforms;

wherein, when the desk is mounted on top of the bed, a height of the first desk platform above the bed platform is greater than a height of the second desk platform above the bed platform.

9. The piece of furniture of claim 8, wherein the platform support is affixed either to (i) a distal end of the first desk platform opposite the vertical head end desk support or (ii) a portion of the first desk platform between the distal end and the vertical head end desk support.

10. The piece of furniture of claim 8, wherein the platform support is affixed either to (i) a distal end of the second desk platform opposite the vertical foot end desk support or (ii) a portion of the second desk platform between the distal end and the vertical foot end desk support.

11. The piece of furniture of claim 8, further comprising:

a work platform affixed to the platform support lower than the first desk platform and higher than the second desk platform and projecting toward the vertical foot end desk support.

12. The piece of furniture of claim 11, wherein the work platform projects substantially horizontally toward the vertical foot end desk support.

13. The piece of furniture of claim 8, further comprising:

a seat affixed to the vertical foot end desk support above the second desk platform and projecting toward the vertical head end desk support.

14. The piece of furniture of claim 8, wherein the first desk platform projects substantially horizontally toward the vertical foot end desk support.

15. The piece of furniture of claim 8, wherein the second desk platform projects substantially horizontally toward the vertical head end desk support.

* * * * *